US005586819A

United States Patent [19]

Bamber et al.

[11] Patent Number: 5,586,819

[45] Date of Patent: Dec. 24, 1996

[54] FLASHLIGHT

[75] Inventors: David J. Bamber, Wichita, Kans.; Benson Leung; Vincent Leung, both of Kowloon, Hong Kong

[73] Assignee: The Coleman Company, Inc., Wichita, Kans.

[21] Appl. No.: 334,429

[22] Filed: Nov. 8, 1994

[51] Int. Cl.[6] ..... F21L 7/00

[52] U.S. Cl. ..... 362/158; 362/202; 362/389

[58] Field of Search ..... 362/158, 187, 362/267, 202, 203, 205, 208, 389; 200/60

[56] References Cited

U.S. PATENT DOCUMENTS

| | | | |
|---|---|---|---|
| 4,151,583 | 4/1979 | Miller | 362/205 |
| 4,286,311 | 8/1981 | Maglica . | |
| 4,388,673 | 6/1983 | Maglica . | |
| 4,398,238 | 8/1983 | Nelson | 362/202 |
| 4,399,496 | 8/1983 | Lengacher | 362/203 |
| 4,527,223 | 7/1985 | Maglica . | |
| 4,577,263 | 3/1986 | Maglica . | |
| 4,656,565 | 4/1987 | Maglica . | |
| 4,658,336 | 4/1987 | Maglica . | |
| 4,819,141 | 4/1989 | Maglica . | |
| 4,823,242 | 4/1989 | Maglica . | |
| 4,841,417 | 6/1989 | Maglica . | |
| 4,851,974 | 7/1989 | Maglica . | |
| 4,864,474 | 9/1989 | Maglica . | |
| 4,881,158 | 11/1989 | Price, III | 362/187 |
| 4,885,668 | 12/1989 | Maglica . | |
| 4,899,265 | 2/1990 | Maglica . | |
| 4,942,505 | 7/1990 | Maglica . | |
| 4,956,755 | 9/1990 | Maglica . | |
| 5,003,440 | 3/1991 | Maglica . | |
| 5,008,785 | 4/1991 | Maglica . | |
| 5,113,326 | 5/1992 | Maglica . | |
| 5,121,308 | 6/1992 | Maglica . | |
| 5,143,441 | 9/1992 | Maglica . | |
| 5,158,358 | 10/1992 | Maglica . | |

FOREIGN PATENT DOCUMENTS

| | | | |
|---|---|---|---|
| 910510 | 6/1946 | France | 362/203 |
| 589698 | 12/1959 | United Kingdom | 362/205 |

OTHER PUBLICATIONS

Coleman 1994 Catalog, pp. 116 and 117 (first published Jul., 1993).

*Primary Examiner*—Y. My Quach

[57] ABSTRACT

A modular flashlight is formed from three parts which are screwed together—a battery housing, a switch housing, and a head. An O-ring at each screw connection provides a substantially watertight seal. A bulb is mounted in the switch housing and a reflector is mounted in the head. Rotation of the head relative to the switch housing varies the focus of the light reflected by the reflector. The head can be removed from the switch housing so that the bulb can provide candle illumination.

4 Claims, 10 Drawing Sheets

95
22
96
94
22

94
97
96
95

24
24
94
96
95

95
96
97
94

129
125
126
127

106
104
105
43
104
112
122
98
99
101
102
100
103

105
112
106
122
127
125

104
128
125
127
126

FLASHLIGHT

BACKGROUND AND SUMMARY

This invention relates to flashlights, and, more particularly, to a modular flashlight having three main parts which are screwed together.

The flashlight described herein includes a battery housing, a switch housing, and a head or reflector housing. The three parts are screwed together, and O-rings provide a substantially watertight seal. A light bulb is mounted on the switch housing and extends into a reflector in the head. As the head is rotated relative to the switch housing, the focus of the light reflected by the reflector changes. The flashlight can be operated with the head completely removed from the switch housing to provide candle illumination. The battery housing and head are provided with unique embossments to facilitate gripping the flashlight and rotating the parts.

DESCRIPTION OF THE DRAWING

The drawing will be explained in conjunction with illustrative embodiments shown in the accompanying drawing, in which.

DESCRIPTION OF SPECIFIC EMBODIMENT

Figure 1:
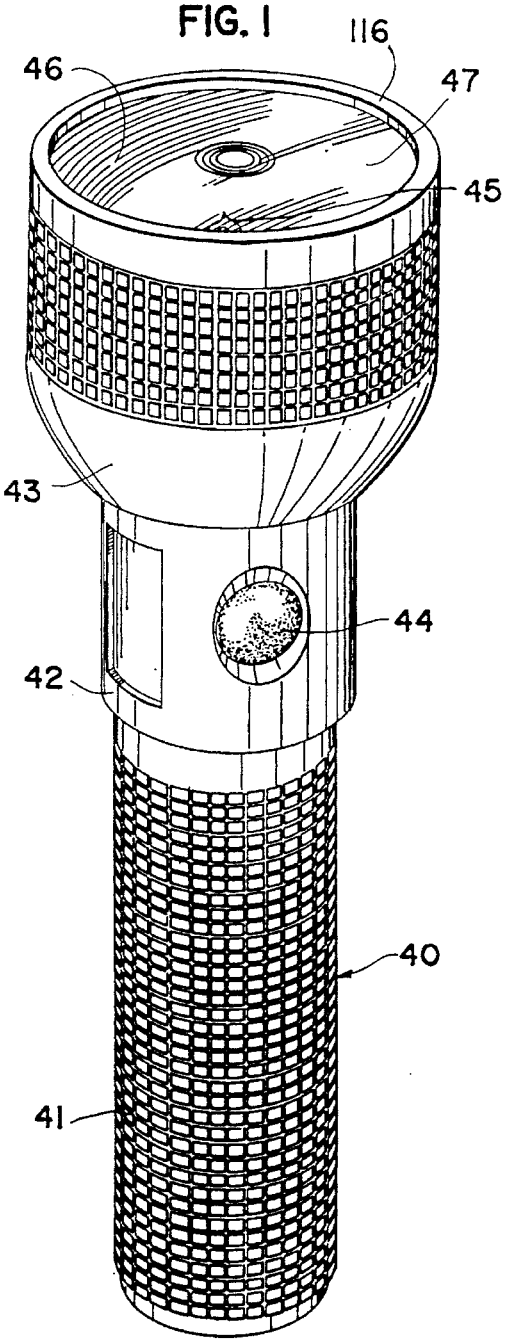
FIG. 1 is a perspective view of a flashlight formed in accordance with the invention.
Figure 2:
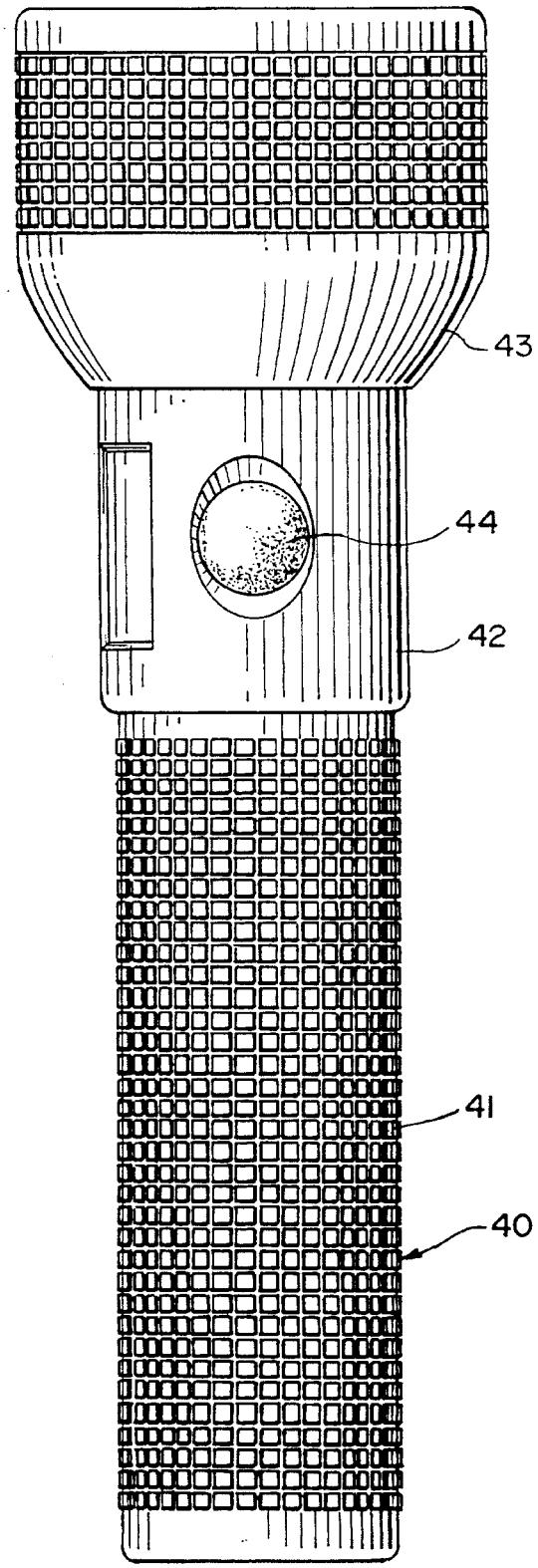
FIG. 2 is an elevational view of the flashlight.
Figure 3:
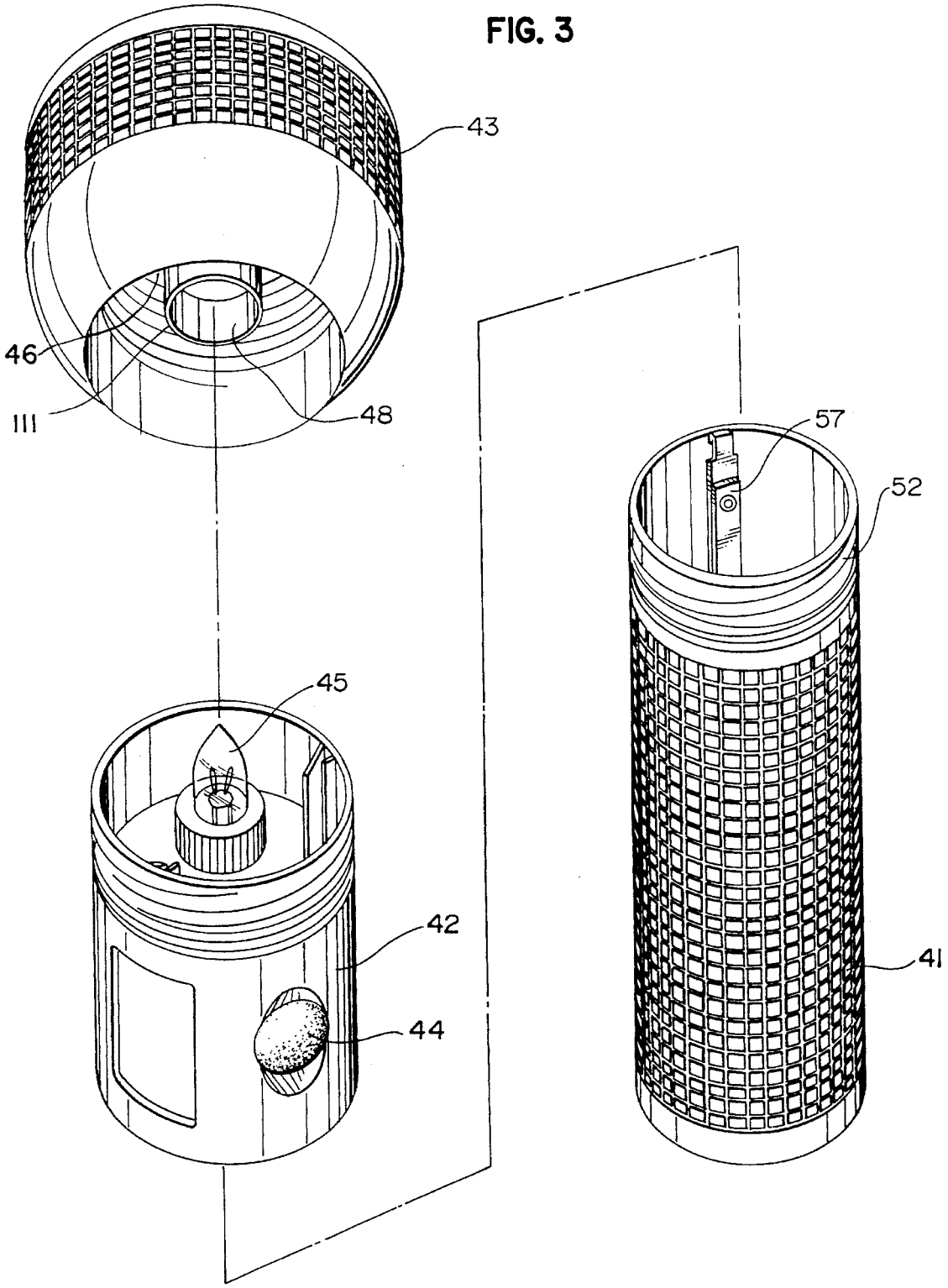
FIG. 3 is an exploded perspective view of the flashlight.
Figure 4:
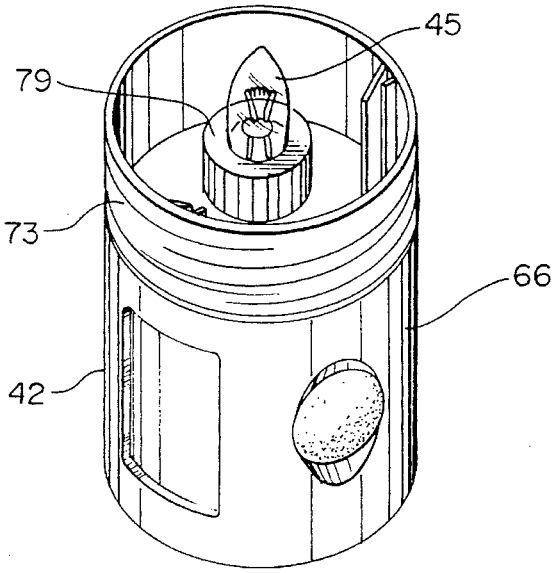
FIG. 4 is a top perspective view of the switch housing.

Referring first to FIGS. 1–3, a flashlight 40 includes a battery housing or case 41, a central housing or switch housing 42, and a head or reflector housing 43. As will be explained more fully hereinafter, the three housings are connected by screw threads.

A conventional pushbutton switch is mounted in the switch housing, and the pushbutton is protected by a rubber cap 44 which is mounted in an opening in the switch housing. A flashlight bulb 45 is mounted within the switch housing. The bulb is powered by conventional dry cell batteries in the battery housing.

A reflector 46 and a transparent lens 47 are mounted in the head. The reflector is provided with a central opening 48 which is sized to receive the bulb 45.

Referring now to FIGS. 7–11, the battery housing 41 includes a cylindrical side wall 50 and a bottom wall 51. The top of the housing is open, and male screw threads 52 are provided on the outside of the upper end. A rubber O-ring 53 is mounted in an annular groove 54 (FIG. 9) below the threads.

Figure 8:
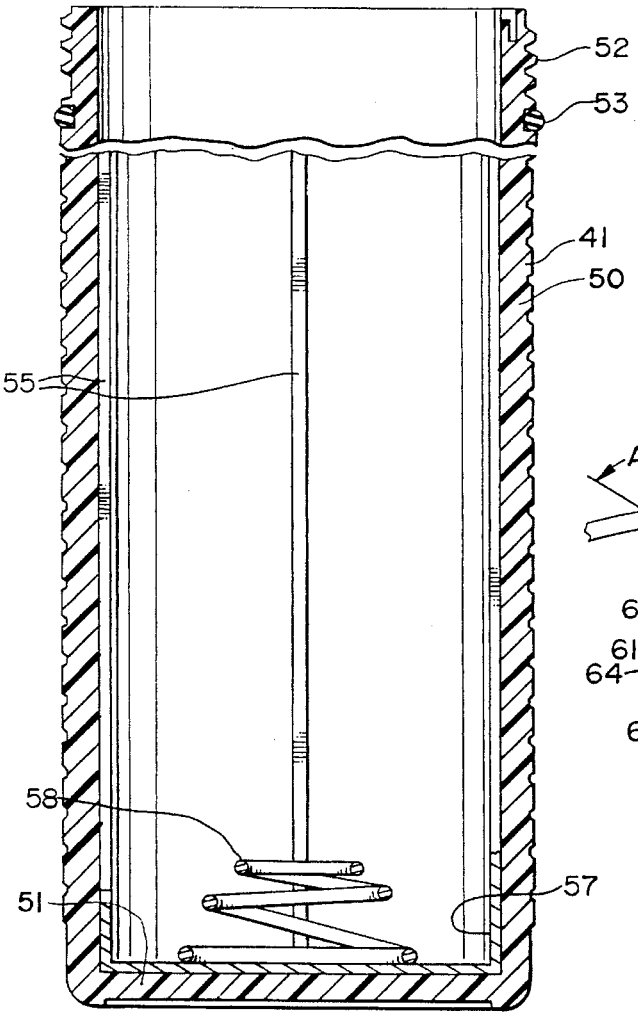
FIG. 8 is a sectional view of the battery housing taken along the line 8—8 of FIG. 7.

A plurality of longitudinally extending ribs 55 are provided on the inside surface of the cylindrical side wall for centering the batteries. An L-shaped slot 56 (FIG. 9) is provided in the top end of the side wall between two of the ribs. The slot receives and anchors an L-shaped end of an electrical contact strip 57 (FIG. 3) which exends along the inside of the side wall 50 and across the bottom wall 51. Only the lower portion of the contact strip is shown in FIG. 8. A conventional coil spring 58 is mounted on top of the contact strip in the bottom of the battery housing for providing electrical contact between the negative terminal of the bottom battery and the contact strip and for biasing the batteries toward the switch housing.

Figure 10:
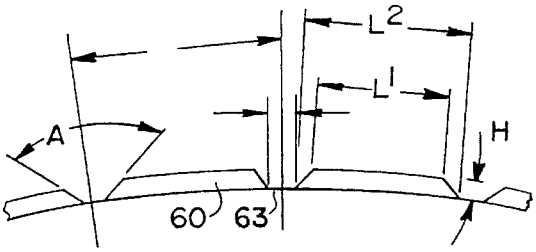
FIG. 10 is an enlarged fragmentary top view of the embossments on the outside surface of the battery housing.
Figure 11:
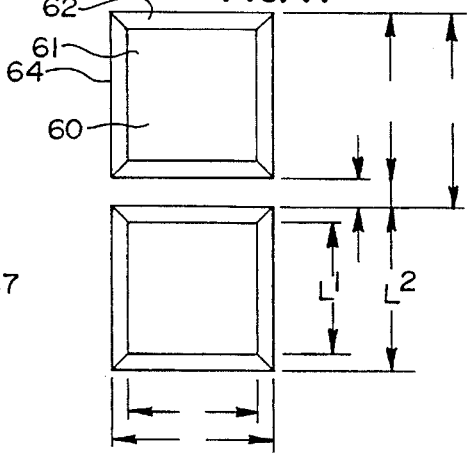
FIG. 11 is a fragmentary side view of the embossments on the battery housing.
Figure 12:
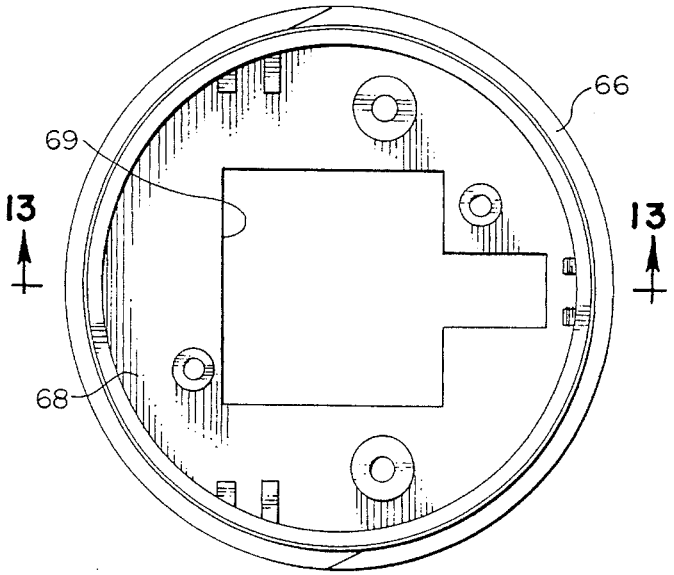
FIG. 12 is a top view of the switch housing.
Figure 14:
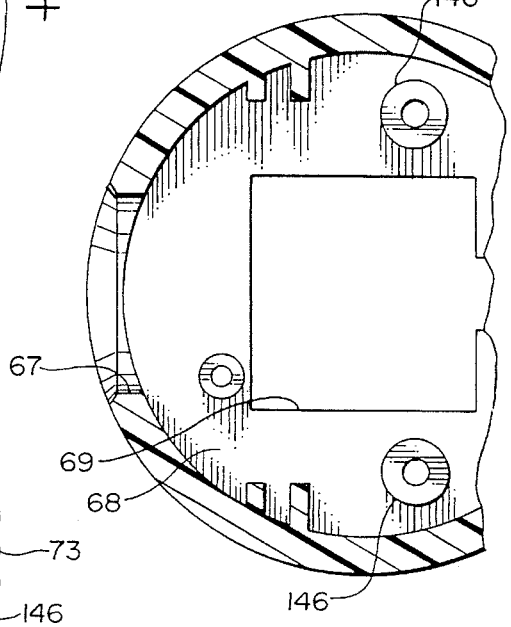
FIG. 14 is a fragmentary sectinal view of the switch housing of FIG. 12, as would be seen along the line 14—14 of FIG. 13.
Figure 13:
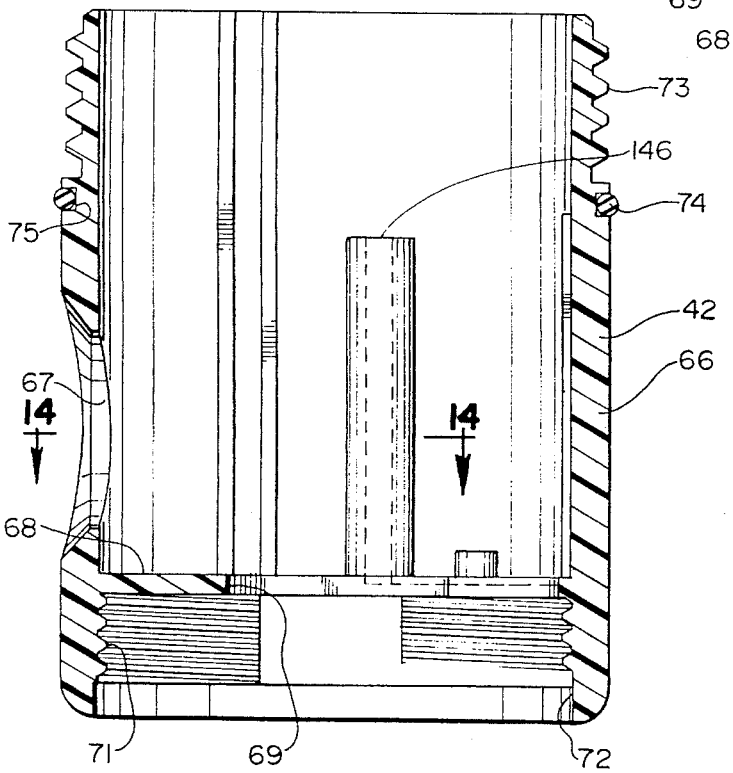
FIG. 13 is a sectional view of the switch housing taken along the line 13—13 of FIG. 12.
Figure 15:
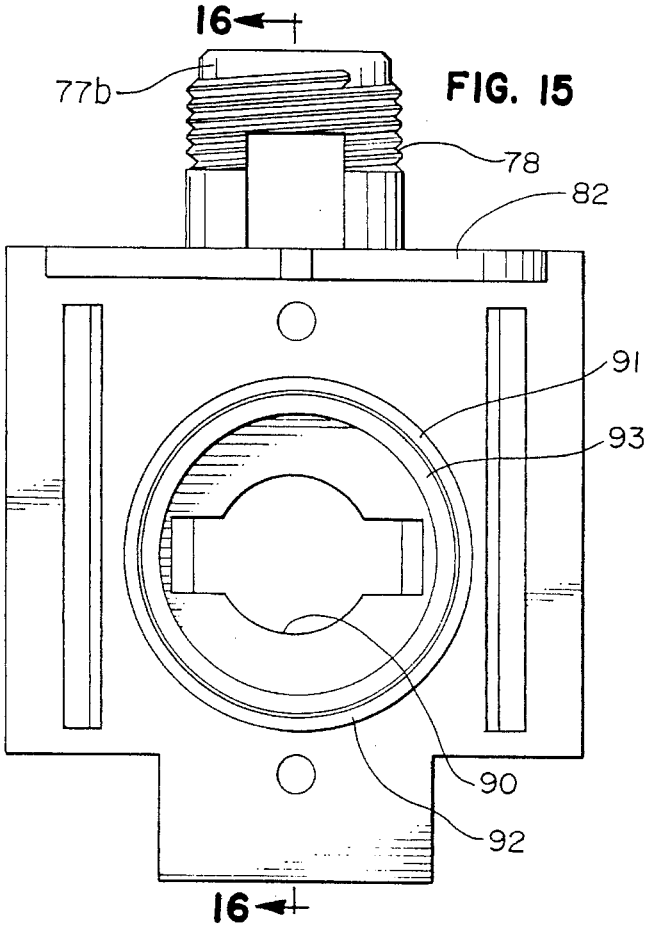
FIG. 15 is a side elevational view of one half of the bulb mounting assembly.
Figure 16:
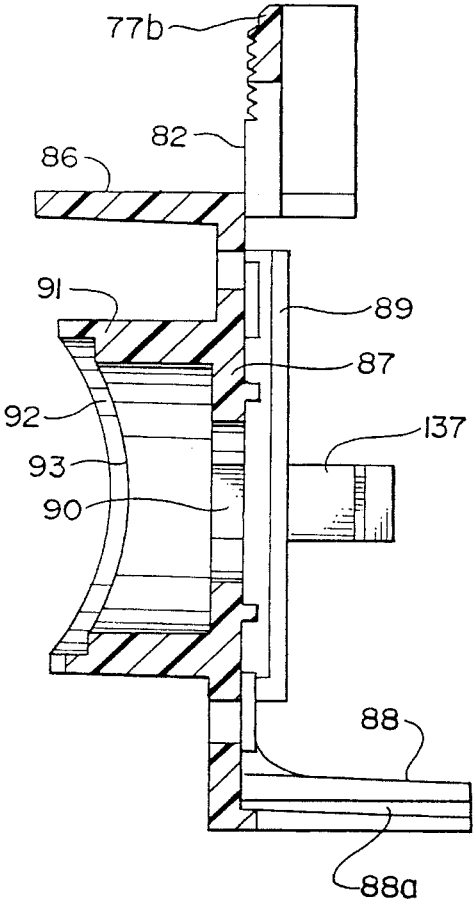
FIG. 16 is a sectional view taken along the line 16—16 of FIG. 15.

The outside surface of the battery housing is knurled or embossed to facilitate gripping the battery housing. As can be seen in FIGS. 10 and 11, the embossments 60 are generally rectangular and include a rectangular outer surface 61 and four trapezoidal side walls 62 which extend angularly outwardly from the cylindrical outer surface 63 of the battery housing and form a rectangular base 64.

In the particular embodiment illustrated, the rectangular outer surface 61 is square, and the length $L^1$ of each side is 2.3 mm. The length $L^2$ of each side of the square base 64 is 2.9 mm. The angle A formed by the sides of adjacent embossments is 90°, and the spacing s between adjacent embossments is 0.5 mm. The height H of the embossments is 0.3 mm.

Referring to FIGS. 4–6 and 12–14, the switch housing 42 includes a cylindrical side wall 66 having open top and bottom ends, an opening 67 for the pushbutton, and transverse wall 68 below the opening for supporting a conventional pushbutton switch assembly. The transverse wall 68 is provided with a generally rectangular opening 69 (FIG. 12) through which a positive battery contact plate 70 (FIG. 5) on the switch assembly extends so that the switch can make contact with the positive terminal of the top battery. A negative contact plate 65 is secured to the bottom surface of the transverse wall 68 and is engageable with the contact strip 57.

The inside surface of the bottom of the switch housing includes female threads 71 which are engageable with the male threads 52 on the battery housing. As the switch housing is screwed onto the battery housing, the contact 70 engages the positive terminal of the top battery, and the flat inside surface 72 (FIG. 13) of the switch housing below the threads 71 engages and compresses the O-ring 53 on the battery housing to provide a substantially watertight seal.

The outside surface of the top of the switch housing is provided with male threads 73. A rubber O-ring 74 is mounted in an annular groove 75 below the threads.

Figure 6:
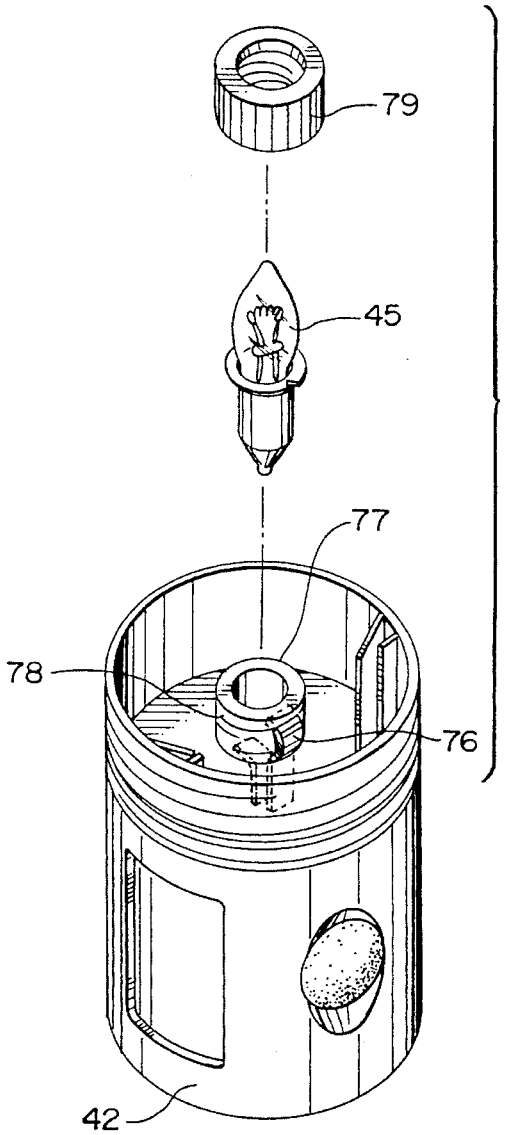
FIG. 6 is an exploded perspective view of the switch housing.
Figure 5:
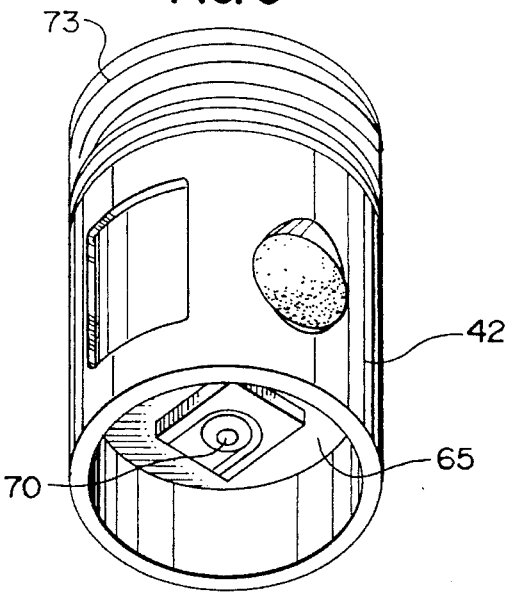
FIG. 5 is a bottom perspective view of the switch housing.
Figure 7:
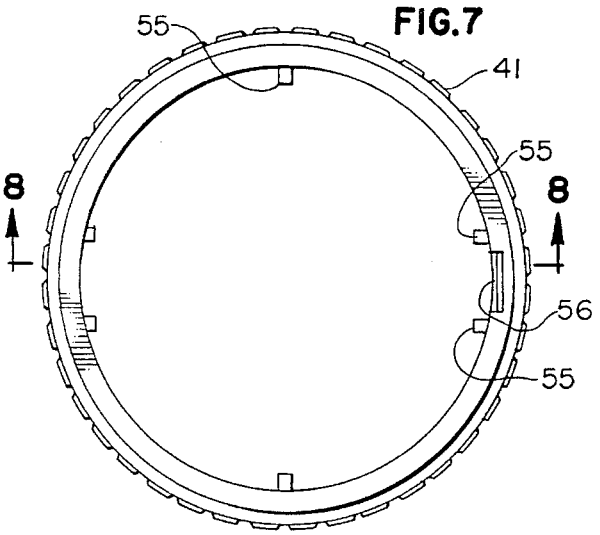
FIG. 7 is a top view of the battery housing.
Figure 9:
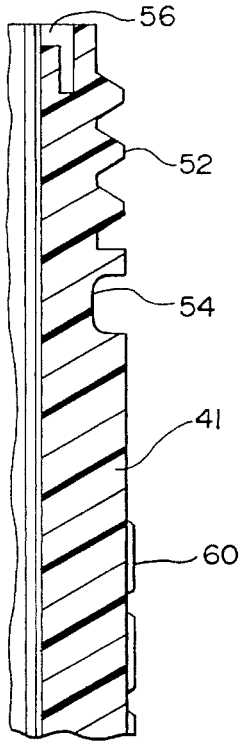
FIG. 9 is an enlarged fragmentary sectional view of the upper end of the battery housing.

The light bulb 45 is mounted with a bulb support sleeve 77 (FIG. 6). The sleeve is provided with external threads 78, and the bulb is held in contact with a terminal 76 on the switch assembly by an internally threaded cap 79 which screws onto the threads 78.

As will be explained hereinafter, the switch housing includes conventional electrical contacts for electrically connecting the bulb to the switch and for connecting the switch to the contacts 57 and 70.

Referring to FIGS. 15–20, the bulb support sleeve 77 is formed from right and left bulb support housings 81 and 82. The housing 81 provides one-half 77*a* of the bulb support sleeve 77, and the housing 82 provides the other half 77*b* of the bulk support sleeve.

The housing 81 includes a flat semicircular top wall 83 and a semicylindrical side wall 84. The ends of the side wall terminate in two radially outwardly extending flanges 85.

The housing 82 includes a flat top wall 86, a flat side wall 87, a pair of bottom tabs 88, and a pair of L-shaped tabs 89 which slidingly receive the flanges 85 on the housing 81 to hold the two housings together. Each of the tabs 88 is provided with a slot 88*a* (FIG. 16), and the battery contact plate 70 is retained within the slots.

The pushbutton switch assembly is positioned between the walls of the housings 81 and 82. The pushbutton extends through an opening 90 in the side wall 87 of the housing 82 and within a cylindrical shroud 91 which extends from the side wall. The shroud 91 includes an outer edge 92 and an inwardly extending shoulder 93 which curve concavely in side elevation (FIG. 16) and convexly in top plan.

The rubber cap 44 (FIGS. 21–24) fits into the open end of the shroud 91 and is positioned in the opening 67 of the switch housing for covering the pushbutton of the switch and for providing a substantially watertight seal of the opening. The cap includes a dome-shaped top 94 which extends outwardly from the opening in the switch housing, a concave-convex bottom edge 95 which engages the shoulder 93 of the shroud 91, and a concave-convex flange 96 which engages the edge 92 of the shroud. A circular recess 97 between the dome 94 and the flange 96 receives the edge of the opening 67 in the switch housing and seals the opening. The cap is flexible and resilient, and the switch is operated by pushing the dome 94 of the cap inwardly toward the switch to depress the pushbutton of the switch.

Figures 21, 22, 23, 24, 25, 26, 27, 28:
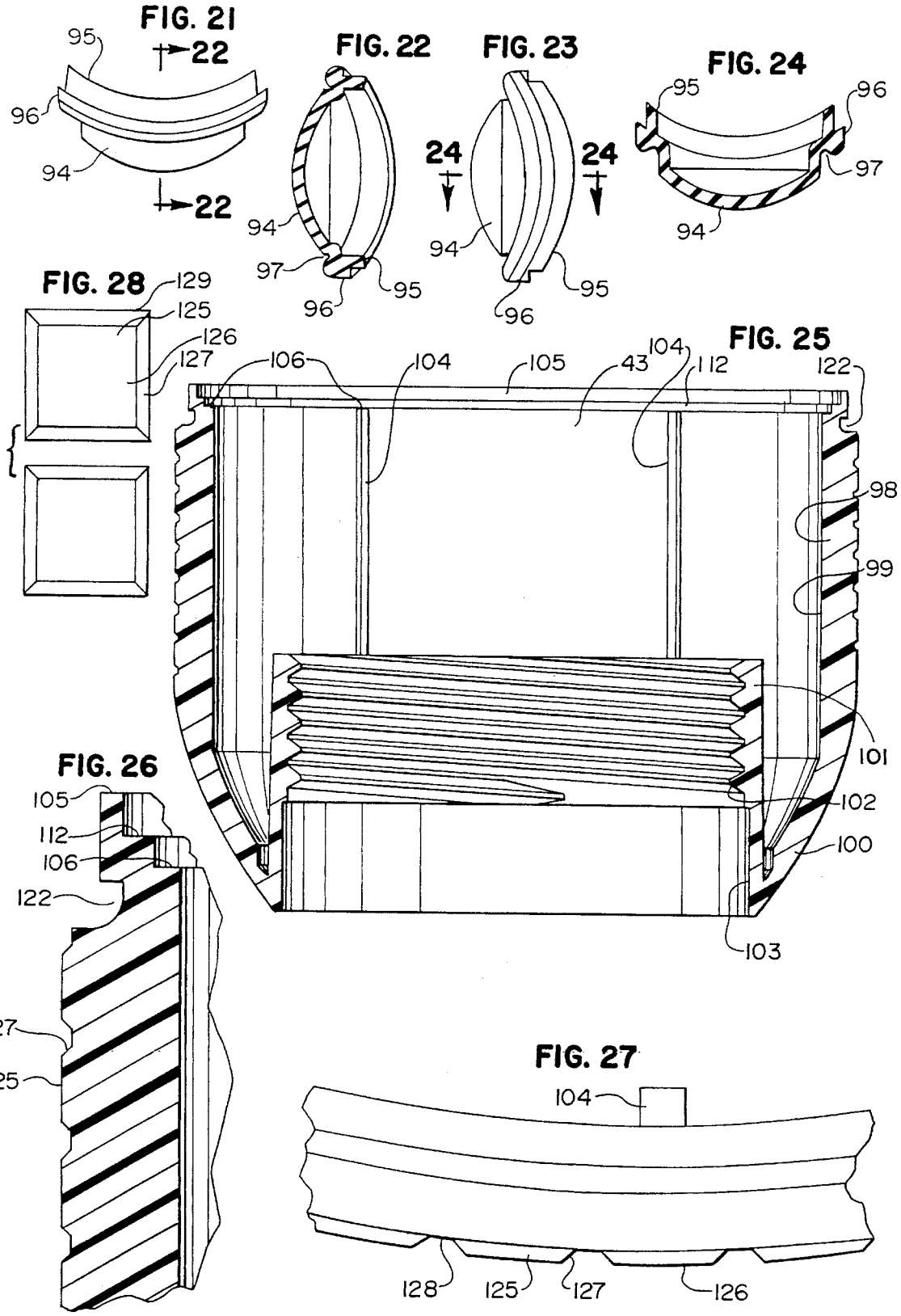
FIG. 21 is a top view of the cap for the pushbutton of the switch.
FIG. 22 is a sectional view taken along the line 22—22 of FIG. 21.
FIG. 23 is a side view of the cap.
FIG. 24 is a sectional view taken along the line 24—24 of FIG. 23.
FIG. 25 is a sectional view of the head.
FIG. 26 is an enlarged fragmentary sectional view of the upper end of the head.
FIG. 27 is a fragmentary top view of the embossments on the head.
FIG. 28 is a fragmentary side view of the embossments on the head.

Referring to FIGS. 25–27, the head 43 includes an outer wall 98 which extends upwardly from the bottom of the outer wall. The outer wall 98 includes an upper cylindrical portion 99 and a lower tapered portion 100. A cylindrical inner wall 101 extends upwardly from the bottom opening of the outer wall.

The inner wall includes internal female screw threads 102 and a flat cylindrical surface 103 below the threads. The threads 102 mate with the male threads 73 on the switch housing 42, and the cylindrical surface 103 sealingly engages the O-ring 74 on the switch housing to provide a substantially watertight seal.

Figure 29:
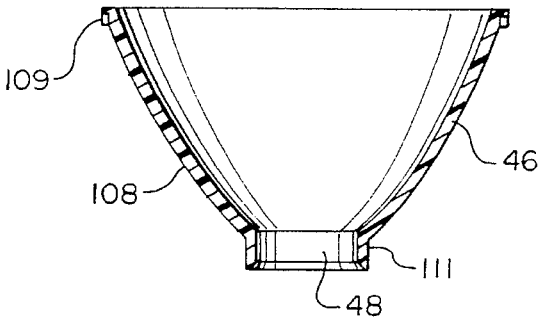
FIG. 29 is a sectional view of the reflector.

A plurality of ribs 104 are provided on the inside surface of the outer wall 98 and terminate below the circular top edge 105 of the outer wall to provide support shoulders 106 for the reflector 46 (FIG. 29). The reflector includes a generally parabolic wall 108 and an annular top flange 109 which is supported by the shoulder 106. The parabolic wall is provided with a circular bottom opening 48 which is surrounded by a cylindrical sleeve 111. The opening 48 is sized to receive the light bulb 45.

Figure 30:
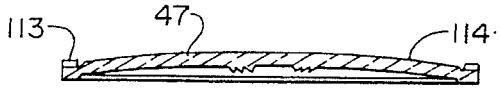
FIG. 30 is a sectional view of the lens.
Figure 31:
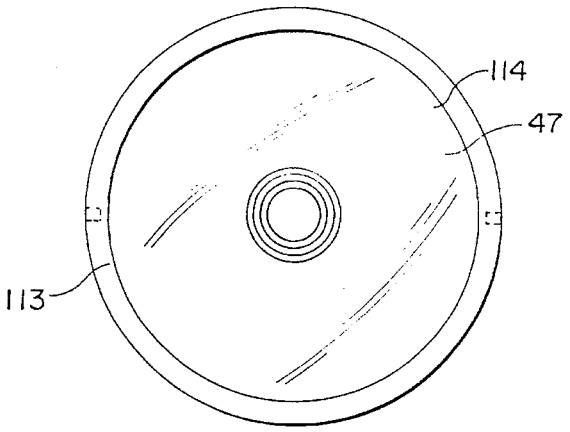
FIG. 31 is a top view of the lens.

The lens 47 is supported by an annular ledge 112 (FIGS. 25 and 26) between the support shoulders 106 and the top edge 105. The lens includes an annular outer edge portion 113 (FIG. 30) and a slightly convex central portion 114.

Figure 32:
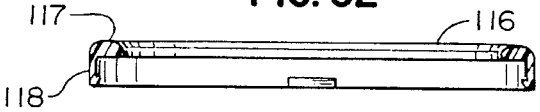
FIG. 32 is a sectional view of the bezel.
Figure 33:
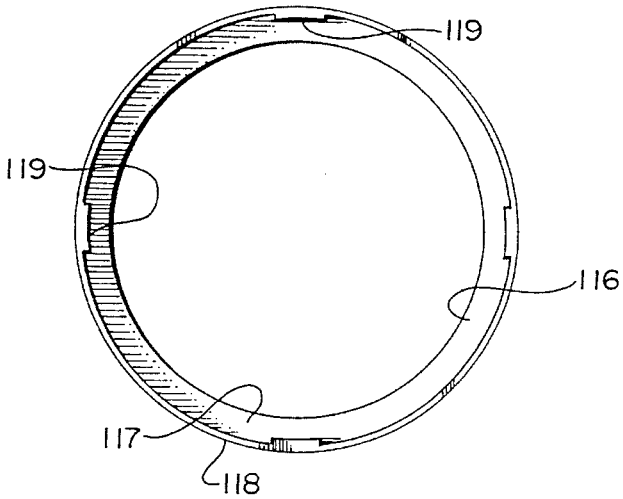
FIG. 33 is a bottom view of the bezel.
Figure 34:
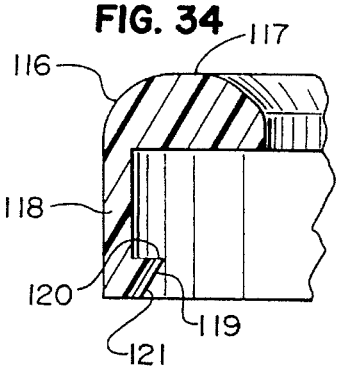
FIG. 34 is a fragmentary sectional view of the bezel.

The lens and reflector are retained within the head 43 by a bezel 116 (FIGS. 32–34). The bezel includes an annular top wall 117 which engages the lens, a cylindrical side wall 118, and four flexible and resilient locking tabs 119 which extend inwardly from the side wall. Each of the locking tabs includes a flat top surface 120 (FIG. 34) and a camming surface 121. As the bezel is pushed over the top of the head the locking tabs are cammed outwardly until they reach a circular groove 122 (FIGS. 25 and 26) in the outer surface of the head. The locking tabs snap into the groove to lock the bezel, lens, and reflector in the head.

The outside surface of the cylindrical wall 99 of the head is knurled or embossed to facilitate gripping the head and rotating the head relative to the switch housing. The embossments 125 (FIGS. 27 and 28) are similar to the embossments 60 of the battery housing 41. Each of the embossments includes a rectangular outer surface 126 and four trapezoidal side walls 127 which extend angularly outwardly from the cylindrical outer surface 128 of the head and form a rectangular base 129.

Figure 35:
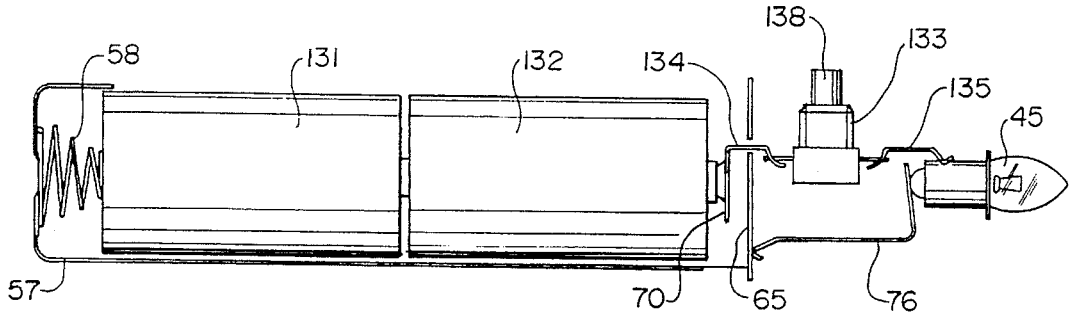
FIG. 35 is a schematic illustration of the electrical circuit of the flashlight.

The wiring diagram of the flashlight is illustrated in FIG. 35. The spring 58 engages the negative terminal of the bottom battery 131 and is electrically connected to the negative terminal of the bulb 45 by the contact strip 57, the contact plate 65, and the negative terminal 76 which is mounted on the bulb support holder.

The battery contact plate 70 engages the positive terminal of the top battery 132 and is connected to pushbutton switch 133 by electrical contact 134. The pushbutton switch is connected to the positive terminal of the bulb by electrical contact 135.

Figure 36:
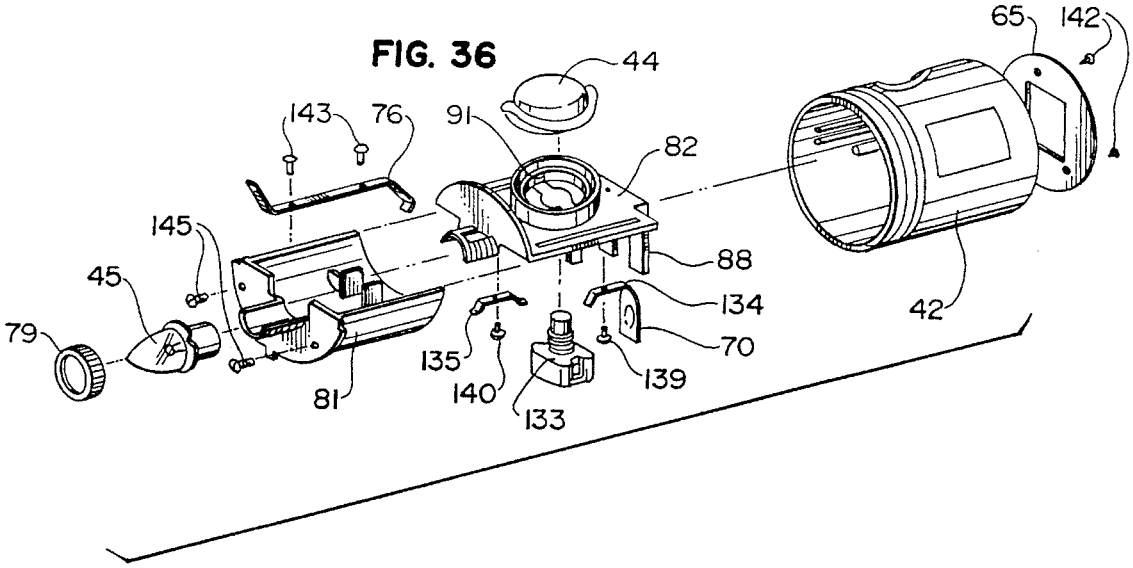
FIG. 36 is an exploded perspective view of the switch housing and bulb support assembly.

Referring to FIG. 36, the pushbutton switch 133 is mounted on the housing 82 by a pair of retaining arms 137 (FIGS. 16 and 17), and the pushbutton 138 extends through the opening 90. The electrical contact 134 is integrally formed on the battery contact plate 70 and is secured to the housing 82 by a rivet 139. Electrical contact 135 is secured to the housing 82 by a rivet 140.

Figure 17:
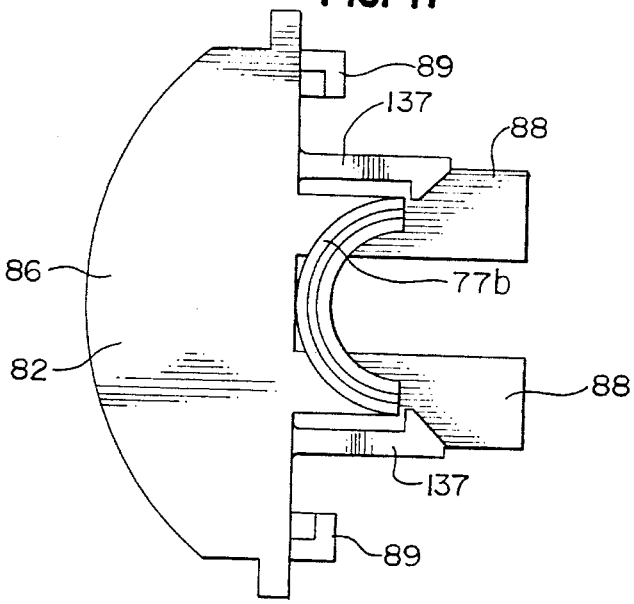
FIG. 17 is a top plan view of FIG. 16.
Figure 20:
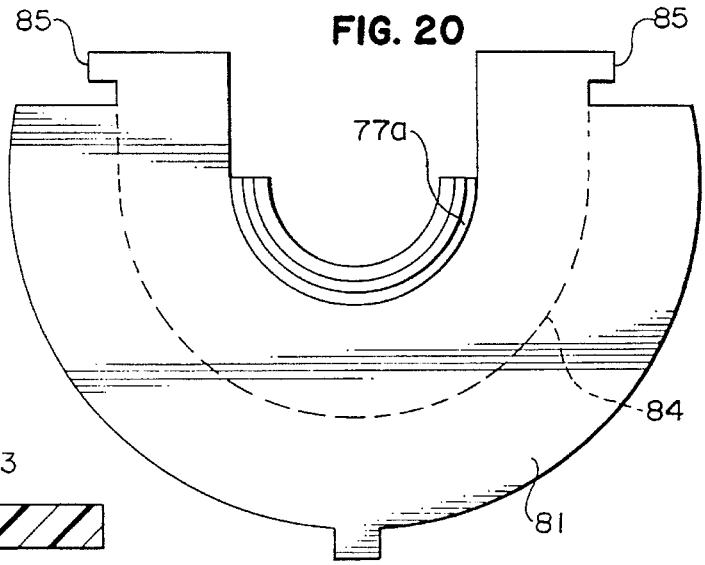
FIG. 20 is a top plan view of FIG. 18.
Figure 19:
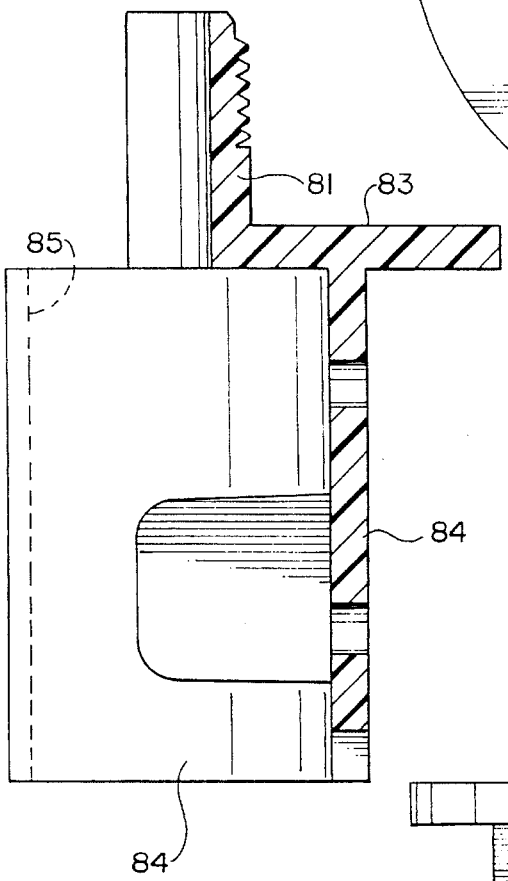
FIG. 19 is a sectional view taken along the line 19—19 of FIG. 18.
Figure 18:
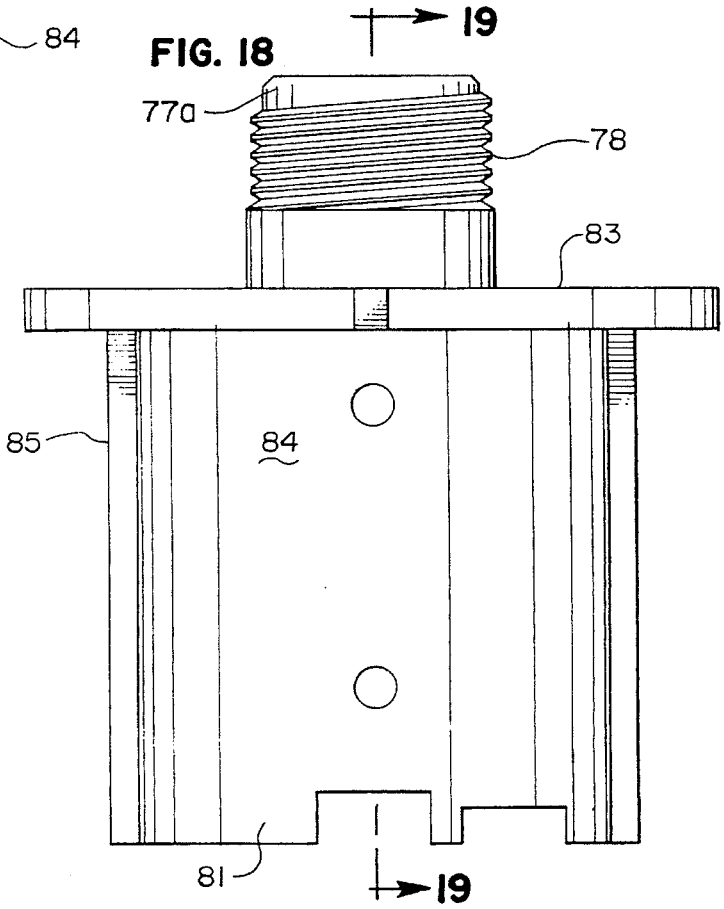
FIG. 18 is a side elevational view of the other half of the bulb mounting assembly.

The negative contact plate 65 is secured to the bottom wall 68 of the switch housing 42 by rivets 142. The negative contact strip 76 is connected to the housing 81 by rivets 143. The housings 81 and 82 are then slidably connected by means of the flanges 85 (FIG. 20) and the tabs 89 (FIG. 17). The rubber cap 44 is mounted on top of the shroud 91, and the assembly is slid into the switch housing 42. The assembly is retained in the switch housing by screws 145 which engage cylindrical posts 146 (FIGS. 13 and 14) in the switch housing. Thereafter, the bulb 45 is mounted on the bulb support sleeve 77 and is secured by the threaded cap 79.

The three main pieces 41–43 of the flashlight form a modular flashlight which can be separated into three separate main parts. The parts are easily connected or separated by means of the screw threads, and each screw connection includes an O-ring for providing a substantially watertight seal.

The number of batteries which are used with the flashlight can be varied simply by unscrewing the battery housing and attaching a battery housing having a different length. For example, the particular battery housing illustrated in the drawing holds two D size batteries. More batteries can be used by using a longer battery housing. The bulb can be replaced, if necessary, by unscrewing the head 43 from the switch housing 42 to expose the bulb.

The focus of the light beam which is reflected from the reflector 46 can be varied by rotating the head 43 relative to the switch housing 42. Rotation of the head changes the axial position of the reflector relative to the light bulb, and the light beam can thereby be focused between a tightly focused spot beam and a diffusely focused broad beam. The axial length of the cylindrical surface 103 of the head is such that the surface remains in sealing engagement with the O-ring 74 throughout the complete range of focus.

The flashlight can also provide candle illumination by completely removing the head 42 from the switch housing. The bulb 45 extends above the top of the switch housing and provides unfocused illumination throughout a complete 360° circle around the flashlight.

While in the foregoing specification a detailed description of a specific embodiment of the invention was set forth for the purpose of illustration, it will be understood that many of the details herein given may be varied considerably by those skilled in the art without departing from the spirit and scope of the invention.

We claim:

1. A flashlight comprising:

a battery housing having a generally cylindrical side wall having an open top end, an inner surface, an outer surface, and a bottom wall, the outer surface of the side wall having male threads adjacent the top end of the battery housing, a generally cylindrical switch housing having a generally cylindrical side wall having open top and bottom ends and inner and outer surfaces, the inner surface of the side wall of the switch housing having female threads adjacent the bottom end of the switch housing, the outer surface of the side wall of the switch housing having male threads adjacent the top end of the switch housing, the female threads of the switch housing being engaged with the male threads on the battery housing, a switch mounted in the switch housing, a bulb holder mounted in the switch housing adjacent the open top end of the switch housing, a light bulb mounted in the bulb holder, a head having an outer wall having open top and bottom ends and a generally cylindrical inner wall extending upwardly from the open bottom end, the inner wall having female threads which are engaged with the male threads on the switch housing, an O-ring mounted on the outer surface of the battery housing adjacent the male threads on the battery housing, the O-ring on the battery housing providing sliding contact and sealingly engaging the inner surface of the side wall of the switch housing over a range of axial motion of the switch housing relative to the battery housing, an O-ring mounted on the outer surface of the side wall of the switch housing adjacent the male threads on the switch housing providing sliding contact and sealingly engaging the inner wall of the head over a range of axial motion of the head relative to the switch housing, a reflector having an open top end which is mounted in the open top end of the head and a reflecting wall which extends downwardly from the open top end of the head toward the inner wall of the head, the reflecting wall having a central opening through which the light bulb extends, and a transparent lens mounted in the open top end of the head.

2. The flashlight of claim 1 in which the head includes a plurality of embossments extending outwardly from the outer wall of the head, each embossment comprising a generally rectangular outer surface and four generally trapezoidal sidewalls which extend angularly outwardly from the outer wall of the head.

3. The flashlight of claim 1 in which the battery housing includes a plurality of embossments extending outwardly from the outer surface of the battery housing, each embossment comprising a generally rectangular outer surface and four generally trapezoidal sidewalls which extend angularly outwardly from the outer surface of the battery housing.

4. A flashlight comprising:

a battery housing having a generally cylindrical side wall having an open top end and a bottom wall, the side wall having male threads adjacent the top end of the battery housing, a generally cylindrical switch housing having a generally cylindrical side wall having open top and bottom ends, the side wall of the switch housing having female threads adjacent the bottom end of the switch housing and male threads adjacent the top end of the switch housing, the female threads of the switch housing being engaged with the male threads on the battery housing, a switch mounted in the switch housing, a bulb holder comprising a first housing having a semi-cylindrical portion having female threads, and a second housing having a semi-cylindrical portion having female threads, said first and second housings mounted in the switch housing adjacent the open top end of the switch housing and the semi-cylindrical portions thereof cooperating to form a female-threaded sleeve, a light bulb mounted in the sleeve, a head having an outer wall having open top and bottom ends and a generally cylindrical inner wall extending upwardly from the open bottom end, the inner wall having female threads which are engaged with the male threads on the switch housing, a reflector having an open top end which is mounted in the open top end of the head and a reflecting wall which extends downwardly from the open top end of the head toward the inner wall of the head, the reflecting wall having a central opening through which the light bulb extends, and a transparent lens mounted in the open top end of the head.

* * * * *